United States Patent [19]

Tsai

[11] 4,430,014

[45] Feb. 7, 1984

[54] BALL POINT PEN WRITING INSTRUMENT

[75] Inventor: Kuo L. Tsai, Taipei, Taiwan

[73] Assignee: Cathay Pen Corporation, Taipei, Taiwan; a part interest

[21] Appl. No.: 253,877

[22] Filed: Apr. 13, 1981

[51] Int. Cl.[3] ..... B43K 7/10

[52] U.S. Cl. ..... 401/216; 401/217; 401/230; 401/242

[58] Field of Search ..... 401/17–21, 401/109–114, 29–33, 132, 133, 135, 187, 188, 190, 191, 196, 198, 199, 202, 207, 209, 213, 214, 216, 217, 195, 210, 215, 230, 242

[56] References Cited

U.S. PATENT DOCUMENTS

| | | | |
|---|---|---|---|
| 2,846,977 | 8/1958 | Aston | 401/216 |
| 2,872,899 | 2/1959 | Trespalacios | 401/227 |
| 2,880,702 | 4/1959 | Joyce | 401/209 |
| 3,427,114 | 2/1969 | Dziuk | 401/199 |
| 3,945,735 | 3/1976 | Nakashiki | 401/216 |
| 4,139,313 | 2/1979 | Hori | 401/216 |

FOREIGN PATENT DOCUMENTS

| | | | |
|---|---|---|---|
| 498040 | 1/1951 | Belgium | 401/217 |
| 1033092 | 6/1958 | Fed. Rep. of Germany | 401/217 |
| 2307620 | 8/1974 | Fed. Rep. of Germany | 401/209 |
| 977336 | 11/1950 | France | 401/217 |
| 1041398 | 5/1953 | France | 401/217 |
| 550564 | 11/1956 | Italy | 401/216 |

*Primary Examiner*—Clyde I. Coughenour

*Attorney, Agent, or Firm*—LeBlanc, Nolan, Shur & Nies

[57] ABSTRACT

A ball point pen writing instrument capable of being simply filled in aqueous ink solution and fitted with a ball point pen to be used as an ordinary writing instrument. When the ink is exhausted it can be refilled for use in the same manner as an ordinary fountain pen.

8 Claims, 10 Drawing Figures

BALL POINT PEN WRITING INSTRUMENT

BACKGROUND OF THE INVENTION

The present invention relates to a ball point pen writing instrument, and more particularly to a ball point pen writing instrument simply using common aqueous ink as its writing medium.

Although the conventional ball point pen has the advantages of convenience, handy, inexpensive etc. however, it still has several disadvantages in practical application such as, easy leaking, frequent build-up of a mass of ink at the pen point during writing, making the written words very hard to identify, and staining on paper and on arms by the ink; frequently a phenomenon of non-continuous flow of ink during writing in Winter time; the words written with it become easy to diffuse and blur after a period of time so that important documents may not be kept for long periods of time.

In view of these disadvantages of conventional ball point pens mentioned above, all the important documents or matters of great concern rely on the fountain pens as writing instruments, because the words written with a fountain pen are clear, remain unblurred, and are not hampered by discontinuous ink flow. However, there are still disadvantages such as, inability to write in any optional direction, pen point easy to split and difficult to duplicate, the sharpness of the pen point causes damage to the writing paper, the capillary ink volume from the pen point not always in the ideal conditions when writing in some soft papers easy to diffuse, and its high cost for making pen point and not long lasting.

On the market are various writing instruments, including signature pens using rolling ball as writing pen point such as, "Sheaffer", "Ball Pentel", etc. As these instruments possess the advantages of both ball point pens and fountain pens to a certain extent, which is capable to fulfill the requirements of the market demand, they have become the favorites of the market of writing instrument for quite some time. The space behind the ink guiding fibers, which can achieve the writing purpose by means of a special quick-drying semi-oily ink with good osmotic property, is conveyed by said core rod with its capillary tube effect. After the ink is exhausted the general users cannot refill by themselves, and/or if the cap is not closed tightly or the pen is laid down for a longer time, the writing medium will be dried out. If the semi-oily ink is switched to the simply aqueous ink for an ordinary fountain pens, the passage of said core rod of ink-guiding fibers will be soon blocked and the pen can not be used again. It is regretful to state that the signature pen with ball point has not embodied fully the advantages of both ball point pens and fountain pens.

Therefore, it is understood that the conventional writing instruments still have many unavoidable disadvantages. Some improvements are obviously need.

SUMMARY OF THE INVENTION

Hence, the primary object of the present invention is to effect improvements on the various disadvantages of conventional ball point pens, fountain pens and signature ball point pens, and provide further a novel ball point writing instrument capable of utilizing the ordinary aqueous ink for general fountain pens and fitted with a ball point in possession of both advantages of fountain pens and ball point pens.

Another object of the present invention is to provide a ball point writing instrument, in which, the front end of the ink-guiding core near the ball point is shaped as a slim tip, and a considerable space is reserved between the inner walls of pen holder, making space entirely usable for storing ink so as to keep the ink stock to a maximum extent, thus, regardless of how long the writing instrument, according to the present invention, is laid down or how much the ambient temperature fluctuates, the ball point can be used successfully to write smoothly.

Still another object of the present invention is to provide a ball point writing instrument, wherein a space is reserved at the portion above a pen point in the pen holder, and extended into the body of the capillary member so as to equalize the inside and outside pressures of the pen holder, thus, regardless of rise or fall of the atmospheric pressure the pen point according to the present invention can be very long lasting to the smooth writing.

BRIEF DESCRIPTION OF THE DRAWINGS

The above and other objects, features and advantages of the present invention will be more apparent from the following descriptions in conjunction with the accompanying drawings, wherein.

DETAILED DESCRIPTION OF THE DRAWINGS

Figure 1:
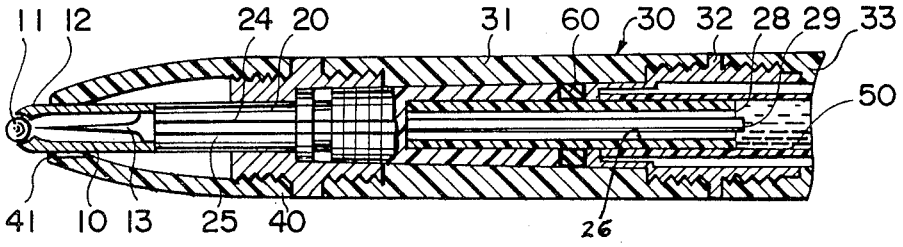
FIG. 1 is a longitudinal cross-section view of one embodiment according to the present invention.
Figure 2A:
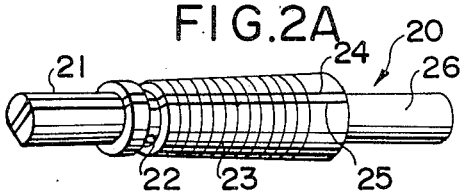
FIG. 2A is a front perspective view of one embodiment of the capillary member of the present invention.

Prior to proceeding the description of the present invention, it should be noted that the similar or corresponding parts in various embodiments according to the present invention are coded with same number for the convenience of cross reference; besides, the pen cap and the ink-storing device to be used in the present invention are of conventional construction and its relevant descriptions are therefore omitted.

As shown in the figures the ball point writing instrument according to the present invention consists mainly of a ball point 10, a capillary member 20 closely contact with the rear end of said ball point 10, an anti-leak packing 60 and an ink-storing tube 50 overslipped at the rear end of said member 20, a pen nib holding means 40 supporting the ball point 10 and connected to the front end of a pen casing 30, the pen casing 30 composed of a front half section 31 and a rear half section 33, and an adapter 32 fitted between the packing 60 and the ink-storing tube 50 and joining the front half section 31 and the rear half section 33 together. The most important features according to the present invention include the ball point 10 and the capillary member 20 as shown in FIGS. 2 and 3.

Figure 3A:
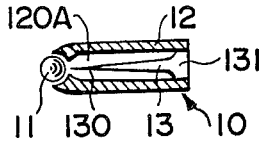
FIG. 3A is a longitudinal cross-section view of the ball point of the present invention.
Figure 2B:
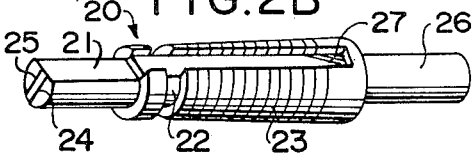
FIG. 2B is a rear perspective view of FIG. 2A.
Figures 3B, 3C:
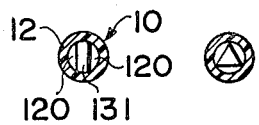
FIG. 3B is a right side view of FIG. 3A.
FIGS. 3C and 3D are cross-section views of the other suitable forms of the ball point of the present invention.
Figure 3D:
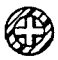

The ball point 10 of the present invention comprises a pen-point housing 12, a rolling ball 11 fitted in the pointed end of said housing 12, and an ink guiding core 13 inserted into said housing 12. It should be emphasized that said ink guiding core 13 and said pen-point housing 12 are held merely by the two lateral faces of a rectangular body 131, the cross section of said core 13 may be formed into a triangular or a cross-shaped body as shown in FIGS. 3C and 3D; a considerable space 120-120 is reserved between the inner walls of said core 13 and said housing 12 as shown in FIG. 3B, and the front end of said core 13 shown in FIG. 3A is diminished into a slim ink-guiding tip 130; there is a slight contacting or a gap of miniature space between the tip 130 of said pen core 13 and the rolling ball 11. The effect of contacting or not contacting will determine the fineness of letters or words written, for example, if it is desired to write fine and small words, both with miniature gap should be chosen.

In addition, the space 120A reserved between the slim tip 130 of the front half of said ink guiding core 13 and the housing 12 is much larger than the space 120 in order to enable 120A to store a large amount of ink, making the writing instrument according to the present invention capable of writing smoothly, even if it is being laid down for a period of time. Since the large amount of ink stored in said space 120A is sufficient to rewet and dissolve the ink residues formed by oxidation and deposition at the ball point due to laying-down too long. Therefore, the writing instrument of the present invention can be used under any circumstances and has the feature of sustaining a smooth writing from the beginning to the end, a fact never realized by using the conventional ball point pens, fountain pens and signature pens. This new development with technical breakthrough results in a very satisfactory writing effect.

Figure 2C:
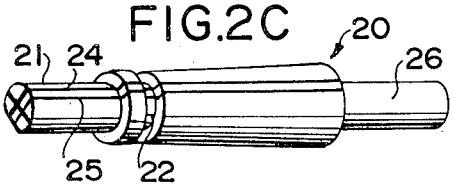
FIG. 2C is a front perspective view of second embodiment of the capillary member of the present invention.

Another important feature according to the present invention is the capillary member 20, which includes a body having several pieces of numerous ring-shaped capillary tubes fins 23 and a ring-shaped slot 22 cut slightly near the front portion of said body, the front and the rear of the relatively smaller diameter portions 21,26 extended forward and backward respectively, from said body at the center of longitudinal lateral face and a longitudinal hole 28 perforated and extended from said rear of the relatively smaller diameter portion into the middle of said body in which an ink-guiding core rod 29 is inserted (see FIG. 1). The front of the relatively smaller diameter portion 21 is in face-to-face abutment contact with the rear end 131 of said ball point pen 10, which provides two functions, namely it serves as a support point for the force of action during writing, and as a capillary tube guiding means for both the pen point and said body. In order to further smooth the guidance and feed of ink, at least one longitudinal capillary grooves 24, 25 are particularly cut on the outer surface of said member 20 and the front of the relatively smaller diameter portion 21, said capillary grooves 24, 25 are further communicated with said hole 28 by cutting into the body through the middle portion thereof. It is preferable that on the foremost end face of the front of the relatively smaller diameter portion 21 may further cut at least one diametrical capillary tubes guide grooves (as shown in FIG. 2C) so as to have them communicate with the guide grooves 24,25 mutually, but the depth of them in the abutting face should not be too deep only enough to achieve some capillary tube effect. Furthermore, one longitudinal slot 27 is cut in the outer surface of said body at the opposite side of the diameter of said two capillary grooves 24, 25 from a rear end of the body 20 to the outer surface of the front of the relatively smaller diameter portion 21, said slot 27 communicates with the air vents 41 in the pen nib holding means 31 and jointly constituting a vent passage of the writing instrument of the present invention with the inner space of said pen nib holding means 40 to facilitate an equilibrant pressure with the pen ambient casing. Ink will never be accumulated in the vent passage. This makes the writing instrument of the present invention not influenced by excessive or defficient ink output due to the fluctuations of the ambient pressure regardless of writing in high flying airplanes or deep diving submarines. This is one of the most prominent features of the present invention which is adaptable for smooth writing at different environments.

The applicant had discovered through many experiments that, owing to a large amount of ink stored in the inner space 120, 120A of the pen point of the present invention, the plurality of fins 23 cut on said body may be omitted. As shown in FIG. 2C, only the longitudinal capillary tubes guides grooves 24, 25 are reserved to also achieve a practically same effect as the construction mentioned above. If necessary more than one capillary groove may be added onto the outer surface of said capillary member 20 (not shown) to enhance its capillary tube ink-guiding function. This paragraph explains adequately the capillary member 20 of the present invention differance with the ink-storing capillary tube effect of ordinary fountain pens. It is feasible to consider as another embodiment the capillary member 20 of the invention.

Figure 2D:
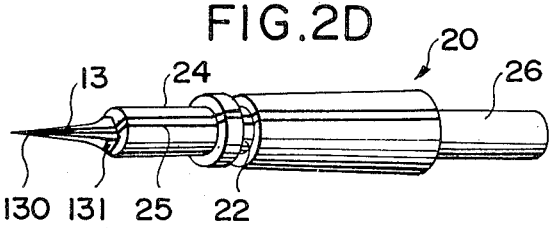
FIG. 2D is a front perspective view of third embodiment of the capillary member of the present invention.

It is to be understood that the ink guiding core 13 may be formed integrally with the foremost end of said capillary member 20, as shown in FIG. 2D. In this manner, the capillary grooves 24, 25 may also be extended to the tip point of said core 13.

It should be further emphasized that, in order to display the functions of said capillary member 20 of the present invention to the extremes and to completely prevent the ink from leaking, the outer surface of said capillary member 20 should be preferably matched closely with the inner wall of the front portion of the pen casing. At the front end of the rear smaller diameter portion 26 of said member 20 a packing 60 is slipped over making the adapter 32 screw in the rear end of the front half section 31 capable of preventing the ink in the storing tube 50 from leaking. In addition, the outer surface of said capillary member 20 matched closely with the inner walls of the front portion of the pen holder will further provide a very effective capillary tube effect for the writing instrument of this invention.

Figure 4:
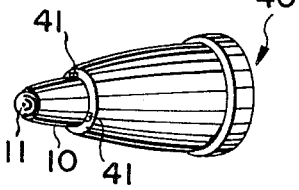
FIG. 4 is a perspective view of a pen nib holding means of the present invention.

As shown in FIGS. 1 and 4, the pen point 10 is held tight by the front end of the pen nib holding means 40 which is threaded onto the front half section 31 of the pen casing 30.

A plurality of slots 41 are cut at the inner wall of the pen nib holding means 40 so that more than one vent is constituted between said slots 41 and the outer surface of the pen-point to equilibrate the air pressures inside and outside the pen casing.

It will be appreciated that the above description of the embodiments are illustrative only and numerous modifications and variations may be made in light of the above teachings. It is therefore to be understood that within the scope of the appended claims, the invention may be practiced otherwise than as specifically described herein.

I claim:

1. A ball point pen writing instrument comprising a pen casing having a front end and a rear end, a central opening at the otherwise closed front end;

a pen-nib holding means fitted at the front end of said casing;

a ball point pen-nib using an ink solution and being nested in front of said holding means by a portion thereof;

an ink storage means positioned at the rear of said casing;

an ink guiding means connected between said pen nib and ink storage means to convey the ink from said ink storage means to the pen nib, said ink guiding means including a capillary member and an ink guiding core, said capillary member having a relatively larger diameter portion at the middle and a relatively smaller diameter portion at the front and at the rear, said relatively larger diameter portion of said capillary member being tightly and frictionally held within the inner surface of the front of said casing, and the rear of the relatively smaller diameter portion of said capillary member being further tightly mounted at the central opening of the closed front end of said casing, the remainder of said relatively smaller diameter portion extending through said central opening at the front end of said casing and projecting out of the same, and having at least one longitudinal capillary groove extending the entire length of the outer surface of said capillary member for transferring ink from said longitudinal capillary groove of said capillary member to said pen nib;

a sealing means overslipped onto the rear relatively smaller diameter portion of said capillary member;

a vent means provided between the inner wall of said pen-nib holding means and the outer surface of the front of said ball point pen-nib;

said ball point pen-nib comprising a pen point housing, a rolling ball held at the pointer end of said pen point housing and an ink-guiding core including a front end having a greatly reduced slim portion and a minor portion of the rear end mounted at the end of said pen nib so that a considerable space is formed between said ink-guiding core and the inner wall of said pen point housing to store a sufficient amount of ink to effect a continuous capillary action for the writing point, the reduced slim point of said ink guiding core making no contact with said writing point;

said capillary member and said ink guiding core being mounted in face-to-face abutment, the abutting face of said capillary member being provided with at least one capillary groove which communicates with said longitudinal capillary groove which is surrounded and enclosed within the housing of said pen-nib holding means and makes no substantial contact with the inner surface of said pen-nib holding means.

2. A writing instrument as claimed in claim 1, wherein said capillary member further comprises the middle portion of a relatively larger diameter portion having a plurality of ring-shaped capillary tube guide fins formed on its outer circumference, a longitudinal hole being perforated and extended from the rear of said relatively smaller diameter portion into the middle of said relatively larger diameter portion of said capillary member, and a capillary tube core rod being inserted into said longitudinal hole, on the outer circumference of said capillary member at least one capillary groove cutting through the entire length of the outer surface of said capillary member and said capillary groove extending through the middle of said capillary member, its depth reaching said longitudinal hole and being communicated therewith, and its cutting length extending further to the utmost front end face of the front of the relatively smaller diameter portion of said capillary member, said utmost end face of said capillary member being in face-to-face abutment with the rear end of said ink-guiding core of said ball point pen nib to thereby accomplish a capillary tube effect and serving as a support point of the force for action of said pen point.

3. A writing instrument as claimed in claim 1, wherein said pen-nib holding means with said pen-nib is capable of removal from said pen casing.

4. A writing instrument as claimed in claim 1, wherein said pen-nib is capable of removal from said pen-nib holding means.

5. A writing instrument as claimed in claim 1, wherein said ink guiding core held in said pen point housing is integrally formed with the foremost end of said capillary member.

6. A writing instrument as claimed in claim 1, wherein said capillary member further comprises an annular slot formed at the front portion of the middle of said relatively larger diameter portion and a longitudinal slot formed from the rear portion of the middle of said relatively larger diameter portion to the foremost end of the front of the relatively smaller diameter portion so that the plurality of the ring-shaped capillary tube guide fins formed on the outer surface of the middle of said relatively larger diameter portion of said capillary member, said longitudinal slot, said annular slot, the inner space of said pen-nib holding means and said vent means formed on the inner wall of said pen-nib holding means are mutually communicated to serve as an air passage for equilibrating the inside and outside air pressure of the pen casing.

7. A writing instrument as claimed in claim 1, wherein the outer surface of said capillary member is formed in a tapered shape so as to match with the inner surface of the tapered hole formed at the front portion of said casing so that a tightly frictional insertion mounting is accomplished to thereby obtain an ink leakage prevention.

8. A writing instrument as claimed in claim 1, wherein said ink-guiding core is made of a kind of ink guiding and reserving material.

* * * * *